US010457074B2

(12) United States Patent
Matsuoka

(10) Patent No.: US 10,457,074 B2
(45) Date of Patent: Oct. 29, 2019

(54) INKJET PRINTER

(71) Applicant: Roland DG Corporation, Hamamatsu-shi, Shizuoka (JP)

(72) Inventor: Hisaya Matsuoka, Hamamatsu (JP)

(73) Assignee: ROLAND DG CORPORATION, Shizuoka (JP)

( * ) Notice: Subject to any disclaimer, the term of this patent is extended or adjusted under 35 U.S.C. 154(b) by 0 days.

(21) Appl. No.: 16/149,333

(22) Filed: Oct. 2, 2018

(65) Prior Publication Data

US 2019/0100035 A1 Apr. 4, 2019

(30) Foreign Application Priority Data

Oct. 2, 2017 (JP) ..... 2017-192478

(51) Int. Cl.

| | |
|---|---|
| ***B41J 29/02*** | (2006.01) |
| ***B41J 11/00*** | (2006.01) |
| ***B41J 29/377*** | (2006.01) |
| *B41M 5/00* | (2006.01) |

(52) U.S. Cl.

CPC ..... *B41J 11/002* (2013.01); *B41J 29/02* (2013.01); *B41J 29/377* (2013.01); *B41M 5/0011* (2013.01)

(58) Field of Classification Search

CPC ..... B41J 11/002; B41J 29/02; B41J 29/377

See application file for complete search history.

(56) References Cited

U.S. PATENT DOCUMENTS

| | | | | |
|---|---|---|---|---|
| 2003/0156177 | A1* | 8/2003 | Nishikawa | B41J 11/0005 347/102 |
| 2006/0021537 | A1* | 2/2006 | Ohtsu | B41J 11/002 101/487 |
| 2015/0029255 | A1 | 1/2015 | Ohnishi | |

FOREIGN PATENT DOCUMENTS

| | | |
|---|---|---|
| JP | 64-11841 A | 1/1989 |
| JP | 6101968 B2 | 3/2017 |

* cited by examiner

*Primary Examiner* — Lamson D Nguyen

(74) *Attorney, Agent, or Firm* — Keating & Bennett, LLP

(57) ABSTRACT

An inkjet printer includes an air blower that blows air toward a recording medium and includes a case including an outlet opening through which external air, taken inside through an inlet opening, is discharged outside, and an opening in a portion facing a table. The case is located at least to one side of an ink head in a main scanning direction. The air blower further includes a fan that is located in the case and sends air through the outlet opening toward the recording medium placed on the table, a heater that is located in the case and heats the air sent from the fan, and a heat radiation layer that is exposed outside through the opening and radiates at least a portion of heat generated by the heater.

10 Claims, 8 Drawing Sheets

INKJET PRINTER

CROSS REFERENCE TO RELATED APPLICATIONS

This application claims the benefit of priority to Japanese Patent Application No. 2017-192478 filed on Oct. 2, 2017. The entire contents of this application are hereby incorporated herein by reference.

BACKGROUND OF THE INVENTION

1. Field of the Invention

The present invention relates to an inkjet printer.

2. Description of the Related Art

Conventionally, an inkjet printer performing printing on a recording medium by an inkjet system is known. This type of inkjet printer includes, for example, a table on which the recording medium is placed (e.g., platen) and an ink head discharging ink toward the recording medium placed on the table.

For example, Japanese Patent No. 6101968 discloses an inkjet recording device including a platen heater that heats a platen. In the recording device disclosed in Japanese Patent No. 6101968, the platen is heated by the heater and thus a recording medium placed on the platen is heated. This promotes drying of ink discharged onto the recording medium. As a result, the ink discharged onto the recording medium is dried quickly. In addition, the recording device disclosed in Japanese Patent No. 6101968 includes an air blower that blows warm air toward the recording medium in order to promote the drying of the ink discharged onto the recording medium. The air blower is mounted on a carriage.

As a recording medium on which printing is to be performed, a relatively thick recording medium may be used. In the case where printing is performed on such a recording medium, the heat of the platen heated by the heater provided on the platen may not be easily transmitted to a surface of the recording medium. In such a situation, the efficiency with which the ink is dried by the air blower provided on the carriage is desired to be increased. In order to increase the amount of heat of the warm air blown by the air blower, the heater provided in the air blower to heat the air needs to be increased in size. In order to increase the amount of the air, a fan provided in the air blower needs to be increased in size. Because such a heater or fan is increased in size, the carriage having the heater or the fan mounted thereon is made heavier, which also increases the size of a driving source that drives the carriage.

SUMMARY OF THE INVENTION

Preferred embodiments of the present invention provide inkjet printers promoting the drying of ink discharged onto a recording medium while preventing an air blower from being increased in size.

An inkjet printer according to a preferred embodiment of the present invention includes a table on which a recording medium is allowed to be placed; an ink head that is located above the table and discharges ink toward the recording medium placed on the table; a carriage that has the ink head mounted thereon and is movable in a main scanning direction; and an air blower that is mounted on the carriage and blows air toward the recording medium. The air blower includes a case including an inlet opening through which external air is taken inside, an outlet opening through which the external air, taken inside through the inlet opening, is discharged outside, and an opening in a portion facing the table, the case being located at least to one side of the ink head in the main scanning direction; a fan that is located in the case, absorbs the external air through the inlet opening and sends air through the outlet opening toward the recording medium placed on the table; a heater that is located in the case and heats the air sent from the fan; and a heat radiation layer that is exposed outside through the opening and radiates at least a portion of heat generated by the heater.

In an inkjet printer according to a preferred embodiment of the present invention, the air heated by the heater is sent through the outlet opening toward the recording medium placed on the table. At least a portion of the heat generated in the heater radiates through the heat radiation layer. Since the heat radiation layer is exposed outside through the opening formed in the case, the heat radiating through the heat radiation layer reaches the ink discharged onto the recording medium. In this manner, the heat generated by the heater is used efficiently, so that the ink discharged onto the recording medium is directly dried by the heated air flowing through the outlet opening and the heat radiating through the heat radiation layer. Therefore, in the case where the recording medium has a common thickness and even in the case where the recording medium is relatively thick, ink discharged onto the recording medium is dried efficiently by the air flowing through the outlet opening and the heat radiating through the heat radiation layer. This prevents a situation where the ink is not easily dried due to the thickness of the recording medium or the like. Since the heat generated by the heater is used efficiently, the heater may be relatively compact, and thus the air blower may be prevented from becoming large.

Preferred embodiments of the present invention promote the drying of ink discharged onto a recording medium while preventing an air blower from being increased in size.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Hereinafter, preferred embodiments of inkjet printers (hereinafter, each referred to as a "printer") according to the present invention will be described with reference to the drawings. The preferred embodiments described herein are not intended to specifically limit the present invention. Components and portions that have the same functions will bear the same reference signs, and overlapping descriptions will be omitted or simplified.

Figure 1:
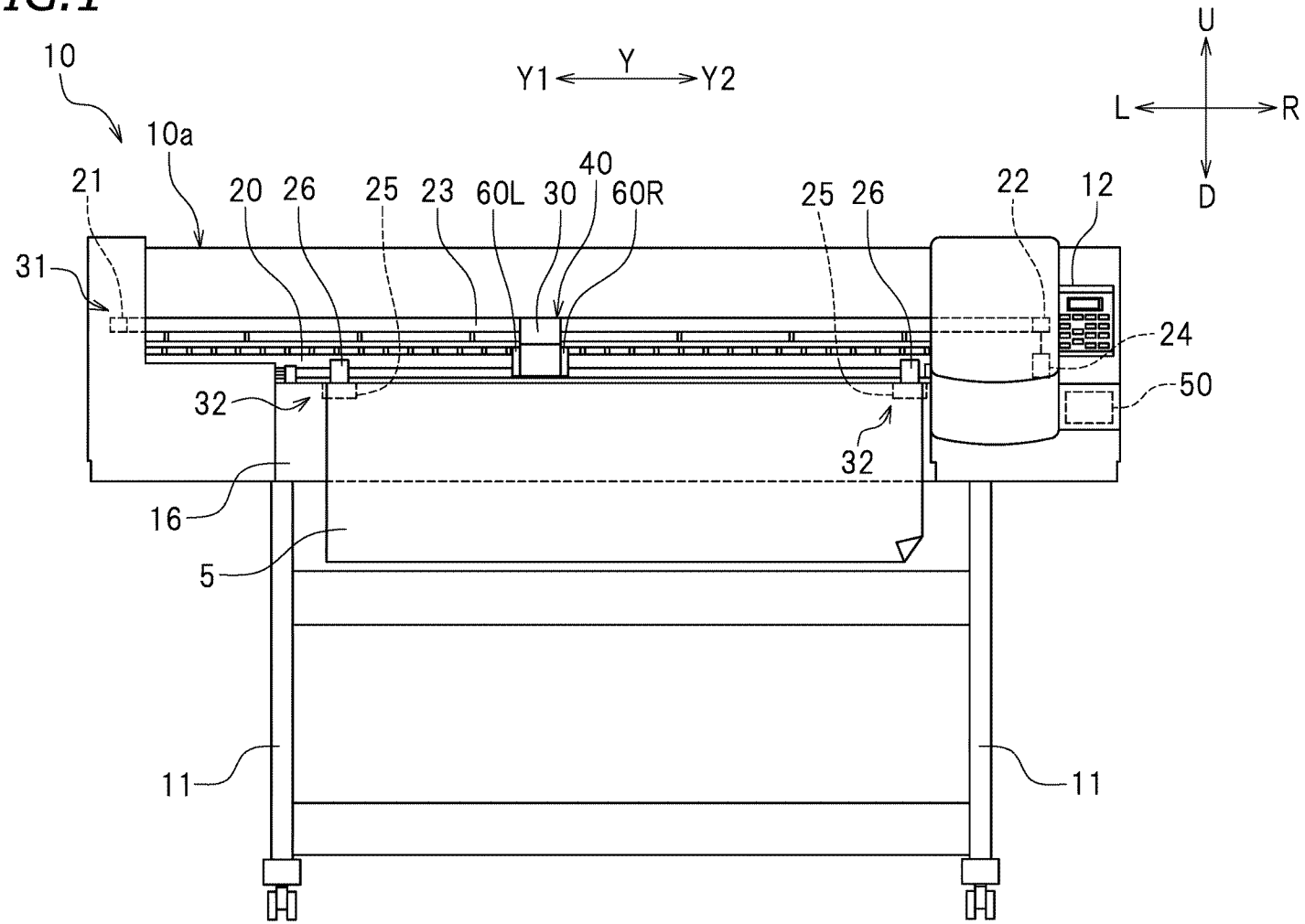
FIG. 1 is a front view of a printer according to a preferred embodiment of the present invention.

FIG. 1 is a front view of a printer 10 according to the present preferred embodiment. In the following description, as seen from a user facing a front surface of the printer 10, a direction away from the printer 10 toward the user is referred to as "forward", and a direction approaching the printer 10 from the user is referred to as "rearward". The terms "left", "right", "up" and "down" respectively refer to left, right, up and down as seen from the user who faces the front surface of the printer 10. In the drawings, letters F, Rr, L, R, U and D respectively represent front, rear, left, right, up and down. In the drawings, letter Y represents a main scanning direction. In this example, the main scanning direction Y is a left-right direction. Letter X represents a sub scanning direction. In this example, the sub scanning direction X is a front-rear direction, and is perpendicular to the main scanning direction Y as seen in a plan view. In this preferred embodiment, a direction from right to left of the printer 10 is referred to as an advancing direction Y1, and a direction from left to right of the printer 10 is referred to as a returning direction Y2. The above-described directions are merely defined for the sake of convenience, and do not limit the manner of installation of the printer 10 in any way, or do not limit the present invention in any way.

The printer 10 is an inkjet printer. The printer 10 is a so-called large-scale printer longer in the main scanning direction Y than a home-use printer. The printer 10 is, for example, an industrial-use printer. In this preferred embodiment, the printer 10 prints an image on a roll recording medium 5 as follows. The roll recording medium 5 is sequentially moved forward, while ink heads 40A, 40B, 40C and 40D (see FIG. 3) mounted on a carriage 30 (see FIG. 2) moving in the main scanning direction Y discharge ink onto the recording medium 5. Thus, an image is printed on the recording medium 5.

The recording medium 5 is, for example, a recording paper sheet. The recording medium 5 is not limited to a recording paper sheet. The recording medium 5 includes, for example, a sheet formed of a resin material such as PVC, polyester or the like, and also includes a metal plate formed of aluminum, iron or the like, a glass plate, a wooden plate and the like that are relatively thick.

As shown in FIG. 1, the printer 10 includes a printer main body 10*a*, legs 11, an operation panel 12, a platen 16, an ink head unit 40, a head moving mechanism 31, a medium transfer mechanism 32, and a controller 50. The printer main body 10*a* includes a casing extending in the main scanning direction Y. The legs 11 support the printer main body 10*a*, and are provided on a bottom surface of the printer main body 10*a*. The operation panel 12 is provided on, for example, a front surface of a right portion of the printer main body 10*a*. There is no specific limitation on the position of the operation panel 12. The operation panel 12, for example, allows the user to perform an operation regarding printing. Although not shown, the operation panel 12 includes a display that displays information on printing, for example, the resolution, the darkness of the ink and the like, the status of the printer 10 during printing, and the like, and also includes an input portion into which information on printing may be input.

The platen 16 supports the recording medium 5 while printing is being performed on the recording medium 5. The platen 16 is an example of a table. The recording medium 5 is placed on the platen 16. Printing on the recording medium 5 is performed on the platen 16. The platen 16 extends in the main scanning direction Y.

The head moving mechanism 31 moves the carriage 30 of the ink head unit 40 in the main scanning direction Y with respect to the recording medium 5 placed on the platen 16. The head moving mechanism 31 moves the carriage 30 in the main scanning direction Y. There is no specific limitation on the structure of the head moving mechanism 31. The head moving mechanism 31 includes a guide rail 20, a pulley 21, a pulley 22, an endless belt 23, and a carriage motor 24. The guide rail 20 guides the carriage 30 to move in the main scanning direction Y. The guide rail 20 is located above the platen 16. The guide rail 20 extends in the main scanning direction Y. The pulley 21 is provided at a left end of the guide rail 20. The pulley 22 is provided at a right end of the guide rail 20. The belt 23 is wound around the pulley 21 and the pulley 22. The right pulley 22 is connected with the carriage motor 24. Alternatively, the carriage motor 24 may be connected with the left pulley 21. In this example, the carriage motor 24 is driven to rotate the pulley 22, and as a result, the belt 23 moves between the pulley 21 and the pulley 22.

As shown in FIG. 1, the ink head unit 40 is located above the platen 16. The ink head unit 40 includes the carriage 30, ink heads 40A through 40D (see FIG. 3), a left air blower 60L and a right air blower 60R.

Figure 2:
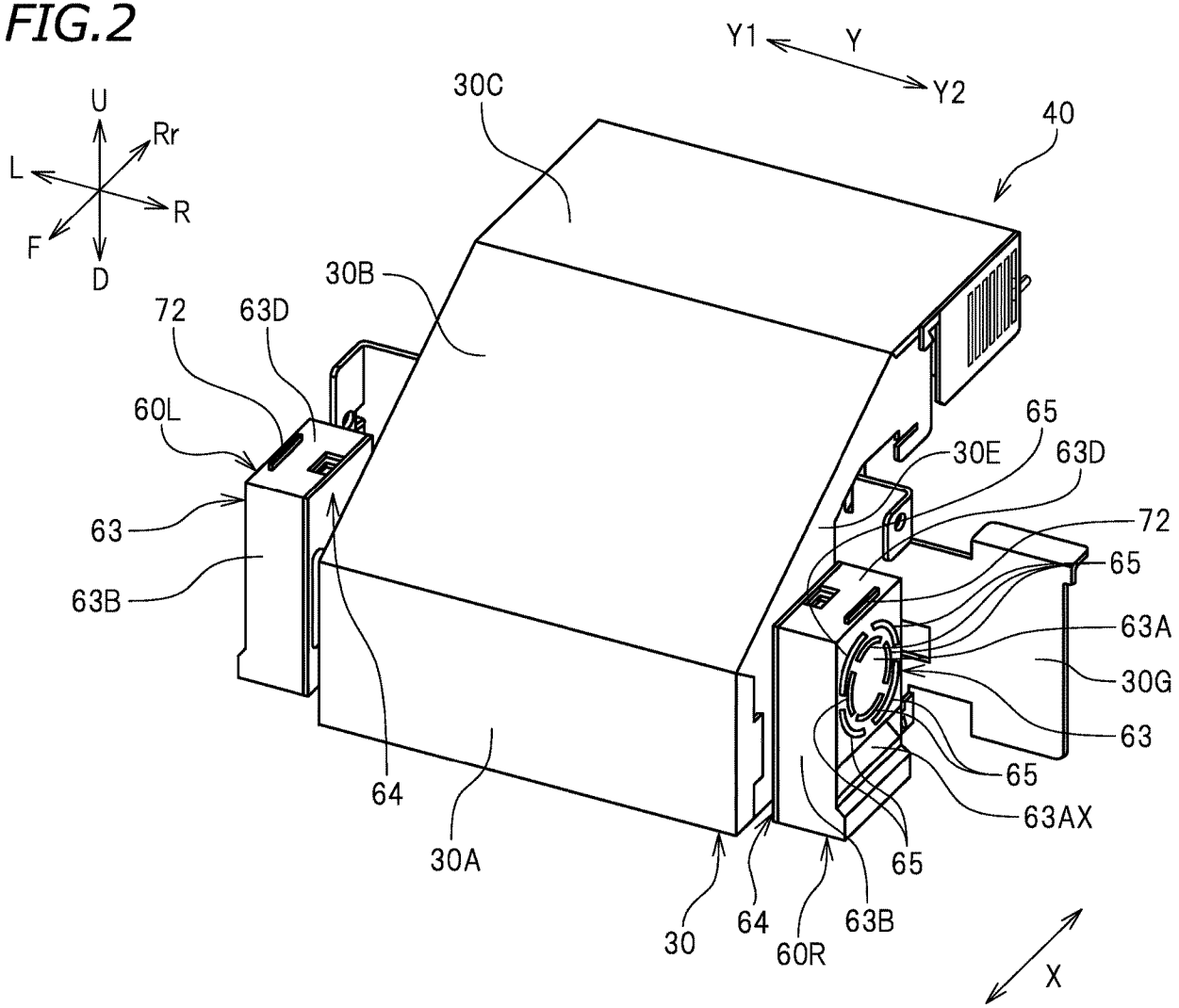
FIG. 2 is a perspective view of an ink head unit according to a preferred embodiment of the present invention.
Figure 3:
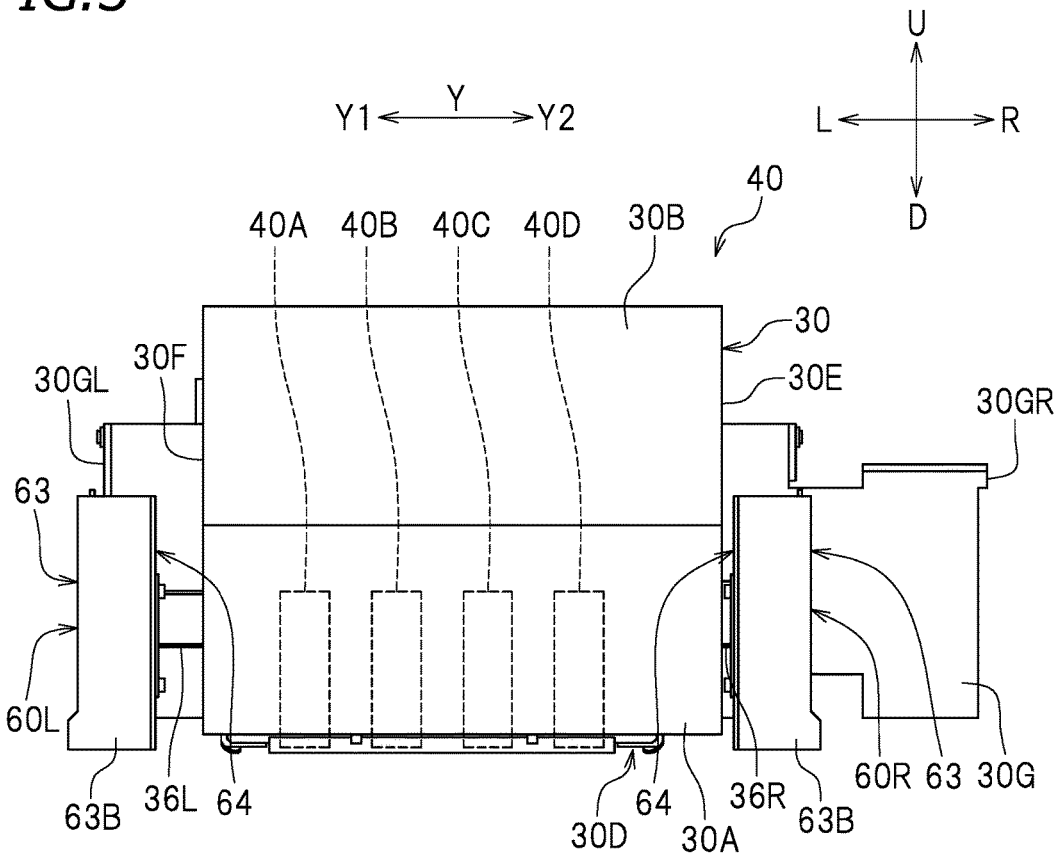
FIG. 3 is a front view of an ink head unit according to a preferred embodiment of the present invention.
Figure 4:
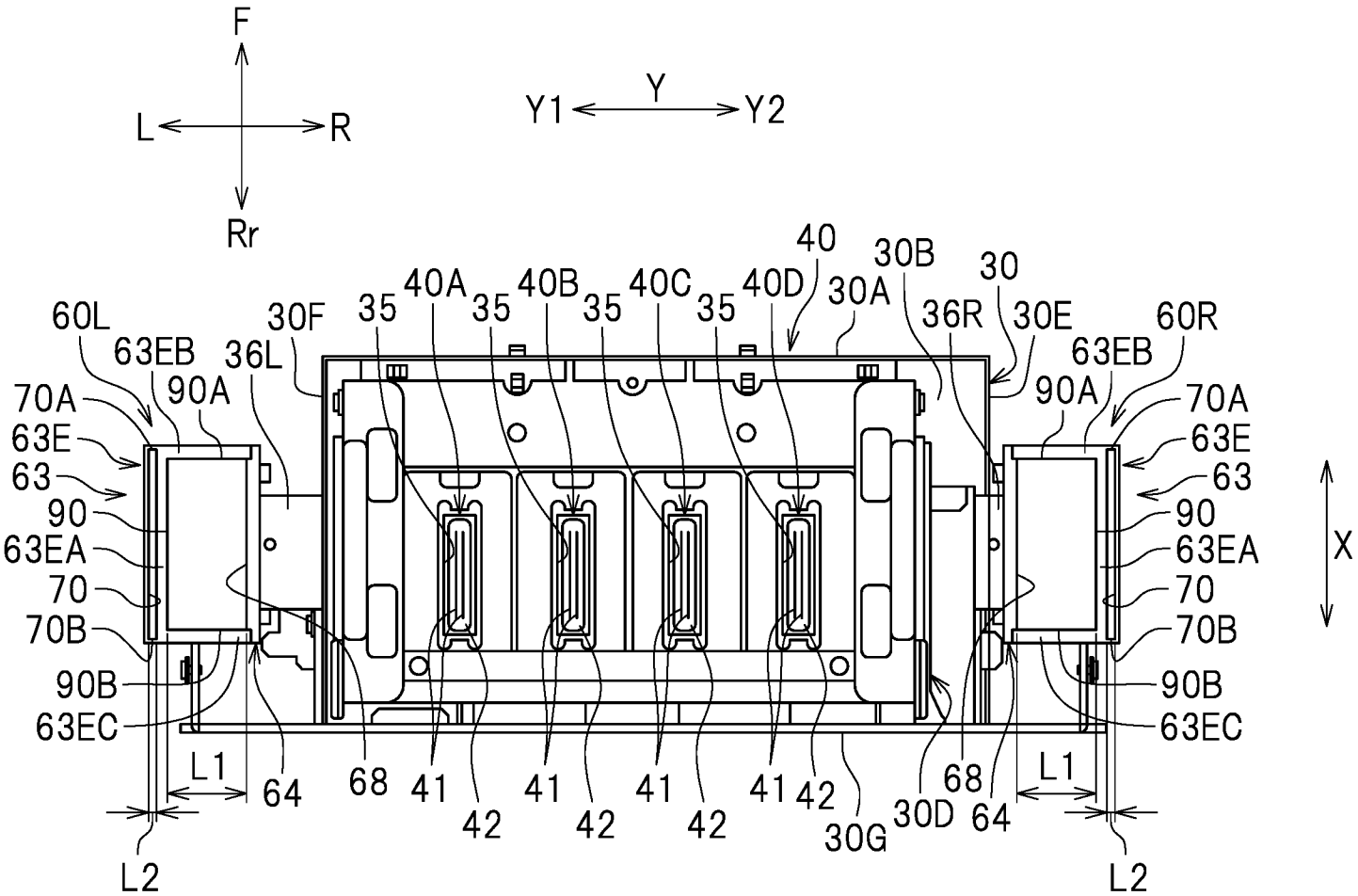
FIG. 4 is a bottom view of an ink head unit according to a preferred embodiment of the present invention.

The carriage 30 is attached to the belt 23. The carriage 30 is in engagement with the guide rail 20, and is slidable with respect to the guide rail 20. The carriage 30 has the ink heads 40A through 40D (see FIG. 3) mounted thereon. The carriage motor 24 is driven to move the belt 23, and as a result, the carriage 30 moves in the main scanning direction Y. Along with this, the ink heads 40A through 40D mounted on the carriage 30 move in the main scanning direction Y. As shown in FIG. 2, the carriage 30 includes a front wall 30A, an inclining wall 30B, a top wall 30C, a bottom wall 30D (see FIG. 4), a right side wall 30E, a left side wall 30F (see FIG. 3), and a rear wall 30G. The front wall 30A extends in an up-down direction and in the left-right direction. The inclining wall 30B extends obliquely rearward and upward from a top end of the front wall 30A. The top wall 30C extends rearward from a top end of the inclining wall 30B. As shown in FIG. 4, the bottom wall 30D is located below the inclining wall 30B. The bottom wall 30D includes openings 35 to which the ink heads 40A through 40D are attached. As shown in FIG. 2, the right side wall 30E connects a right end of the front wall 30A, a right end of the inclining wall 30B and a right end of the top wall 30C. The left side wall 30F connects a left end of the front wall 30A, a left end of the inclining wall 30B and a left end of the top wall 30C. The rear wall 30G is located below the inclining wall 30B. The rear wall 30G extends in the main scanning direction Y. As shown in FIG. 3, a right end 30GR of the rear wall 30G is located to the right of the right side wall 30E. A left end 30GL of the rear wall 30G is located to the left of the left side wall 30F. The rear wall 30G is connected with the bottom wall 30D, but is separate from the inclining wall 30B.

As shown in FIG. 4, the ink heads 40A through 40D are arrayed in the main scanning direction Y. The ink heads 40A through 40D are shaped to be longer in the front-rear direction than in the left-right direction. The ink heads 40A through 40D have the same shape and the same size as each other. The ink heads 40A through 40D each include a plurality of nozzles 41 arrayed in the sub scanning direction X and a nozzle surface 42 in which the nozzles 41 are provided. The nozzles 41 discharge ink toward the recording medium 5 placed on the platen 16. The nozzles 41 are very small and thus are represented by straight lines in FIG. 4. In this preferred embodiment, the ink heads 40A through 40D each include the nozzles 41 in two lines. Alternatively, the ink heads 40A through 40D may each include the nozzles 41 in one line or in three or more lines. The ink heads 40A through 40D are movable in the main scanning direction Y along the guide rail 20 via the carriage 30.

The medium transfer mechanism 32 moves the recording medium 5 placed on the platen 16 in the sub scanning direction X with respect to the carriage 30. In this example, the medium transfer mechanism 32 moves the recording medium 5 placed on the platen 16 in the sub scanning direction X (see FIG. 2). There is no specific limitation on the structure of the medium transfer mechanism 32. As shown in FIG. 1, the medium transfer mechanism 32 includes grit rollers 25, pinch rollers 26, and a feed motor 27 (see FIG. 5). The grit rollers 25 are provided in the platen 16. In this example, the grit rollers 25 are each provided in the platen 16 such that a top portion thereof is exposed. The pinch rollers 26 press the recording medium 5 from above. The pinch rollers 26 are located above the grit rollers 25 so as to face the grit rollers 25 in the up-down direction. The pinch rollers 26 may be movable in the up-down direction in accordance with the thickness of the recording medium 5. There is no specific limitation on the positions or the numbers of the grit rollers 25 or the pinch rollers 26. In this preferred embodiment, the grit rollers 25 are provided at a left end and a right end of the platen 16, and the pinch rollers 26 are also provided at the left end and the right end of the platen 16. The feed motor 27 is connected with the grit rollers 25. In a state where the recording medium 5 is held between the grit rollers 25 and the pinch rollers 26, the feed motor 27 is driven to rotate the grit rollers 25, and as a result, the recording medium 5 is transferred in the sub scanning direction X.

The left air blower 60L and the right air blower 60R blow air toward the recording medium 5 placed on the platen 16. As shown in FIG. 3, the left air blower 60L is located to the left of the ink head 40A. The right air blower 60R is located to the right of the ink head 40D. The left air blower 60L and the right air blower 60R are mounted on the carriage 30. In more detail, the left air blower 60L is attached to a left stay 36L provided on the left side wall 30F and the rear wall 30G of the carriage 30. The right air blower 60R is attached to a right stay 36R provided on the right side wall 30E and the rear wall 30G of the carriage 30. The left air blower 60L and the right air blower 60R are located left-right-symmetrically in the main scanning direction Y. Namely, as shown in FIG. 4, the left air blower 60L is located such that an outlet opening 70 thereof (described below) is located to the left of a heat radiation layer 90 thereof, and the right air blower 60R is located such that an outlet opening 70 thereof is located to the right of a heat radiation layer 90 thereof. The left air blower 60L and the right air blower 60R are movable in the main scanning direction Y along the guide rail 20 via the carriage 30.

Figure 6:
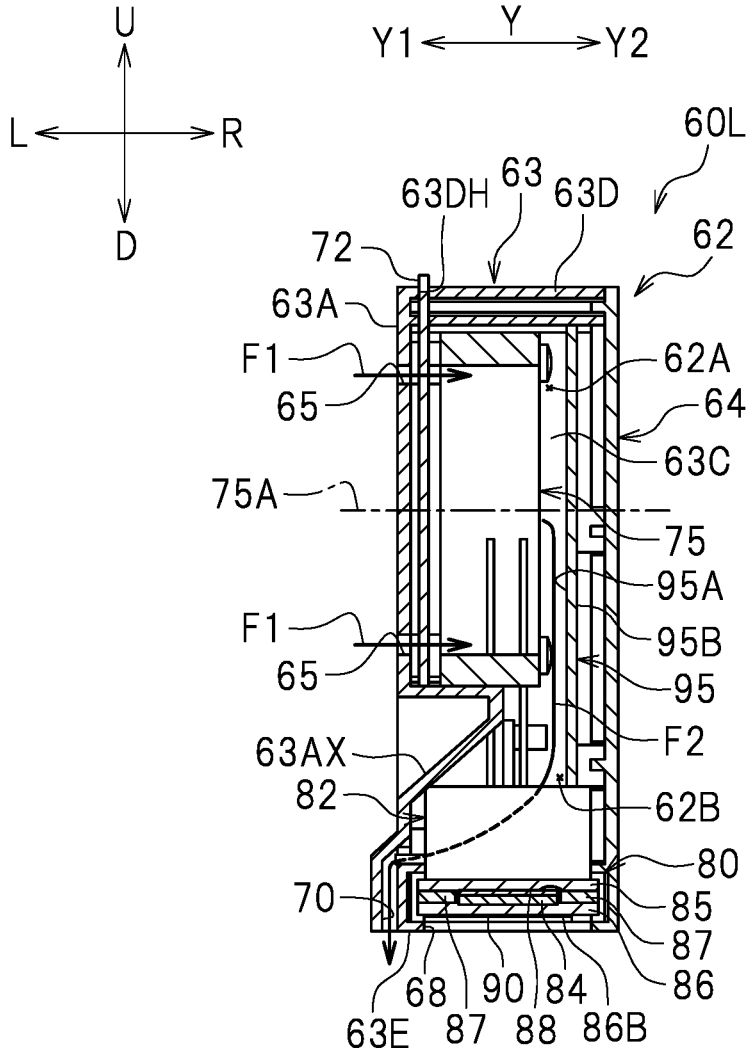
FIG. 6 is a cross-sectional view of an air blower according to a preferred embodiment of the present invention.

Hereinafter, structures of the left air blower 60L and the right air blower 60R will be described in detail. The structure of the right air blower 60R is substantially the same as that of the left air blower 60L except for being located left-right symmetrically to the left air blower 60L. Thus, the structure of the left air blower 60L will be described, and the same description on the right air blower 60R will be omitted. As shown in FIG. 6, the left air blower 60L includes a case 62, a fan 75, a heater 80, and a circuit board 95.

Figure 7:
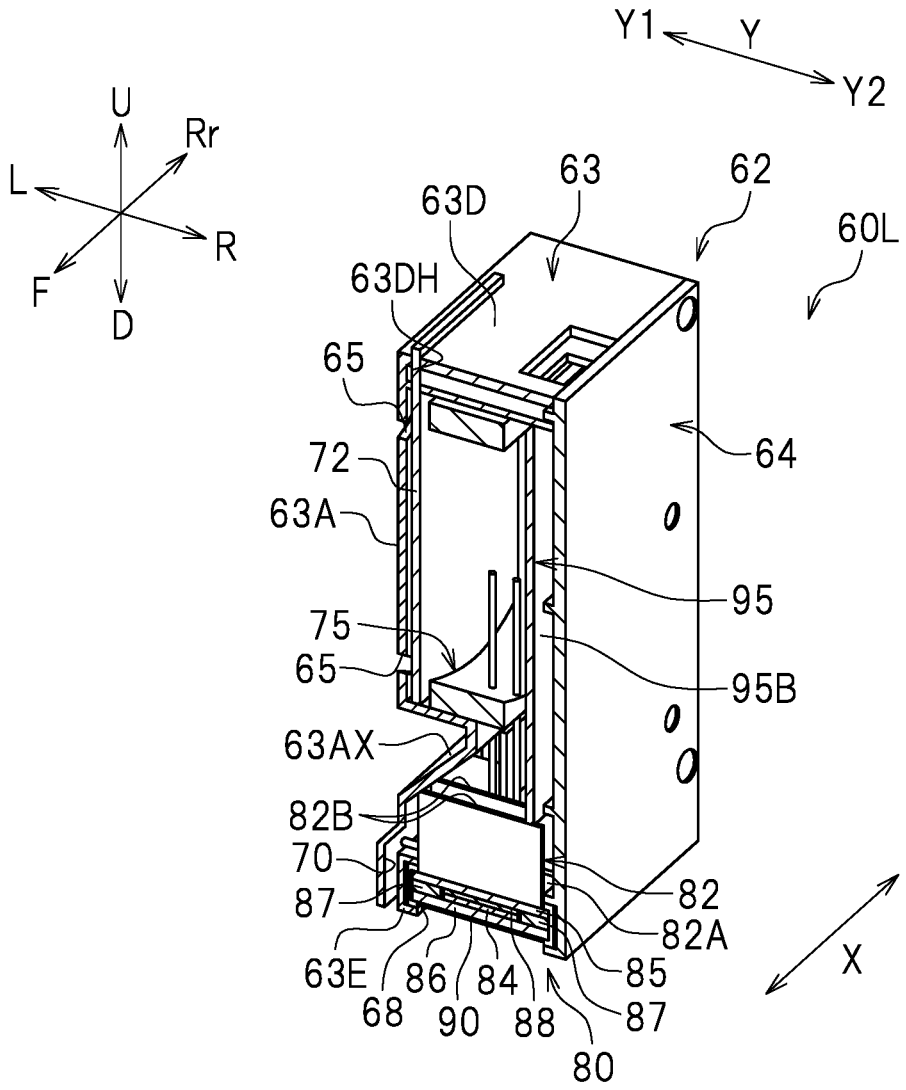
FIG. 7 is a perspective view of an air blower according to a preferred embodiment of the present invention, showing a cross-section thereof.

As shown in FIG. 7, the case 62 includes a case main body 63 and a cover 64. The case 62 includes an inner space 62A (see FIG. 6) enclosed by the case main body 63 and the cover 64. Air flows into, and flows out of, the inner space 62A through a plurality of inlet openings 65 and the outlet opening 70 (described below). The case main body 63 includes a first wall 63A, a second wall 63B (see FIG. 2), a third wall 63C (see FIG. 6), a fourth wall 63D and a fifth wall 63E.

The first wall 63A extends in the up-down direction and in the front-rear direction. The first wall 63A is located to face the cover 64. As shown in FIG. 6, the first wall 63A includes a recessed portion 63AX. With such a structure, air sent from the fan 75 is rectified and is sent to the outlet opening 70 efficiently. The second wall 63B extends rightward from a front end of the first wall 63A. The second wall 63B is rectangular. The third wall 63C extends rightward from a rear end of the first wall 63A. The third wall 63C is located to face the second wall 63B. The third wall 63C is rectangular. The fourth wall 63D connects a top end of the first wall 63A, a top end of the second wall 63B and a top end of the third wall 63C. The fourth wall 63D includes an insertion hole 63DH. The fifth wall 63E is located to face the fourth wall 63D.

As shown in FIG. 4, the fifth wall 63E is generally U-shaped. In more detail, the fifth wall 63E includes a first portion 63EA extending in the front-rear direction, a second portion 63EB extending rightward from a front end of the first portion 63EA, and a third portion 63EC extending rightward from a rear end of the first portion 63EA. The fifth wall 63E is located to face the platen 16. The cover 64 is attached to the case main body 63. The cover 64 is shaped like a flat plate. The cover 64 of the left air blower 60L is secured to the left stay 36L. The cover 64 of the right air blower 60R is secured to the right stay 36R.

Figure 8:
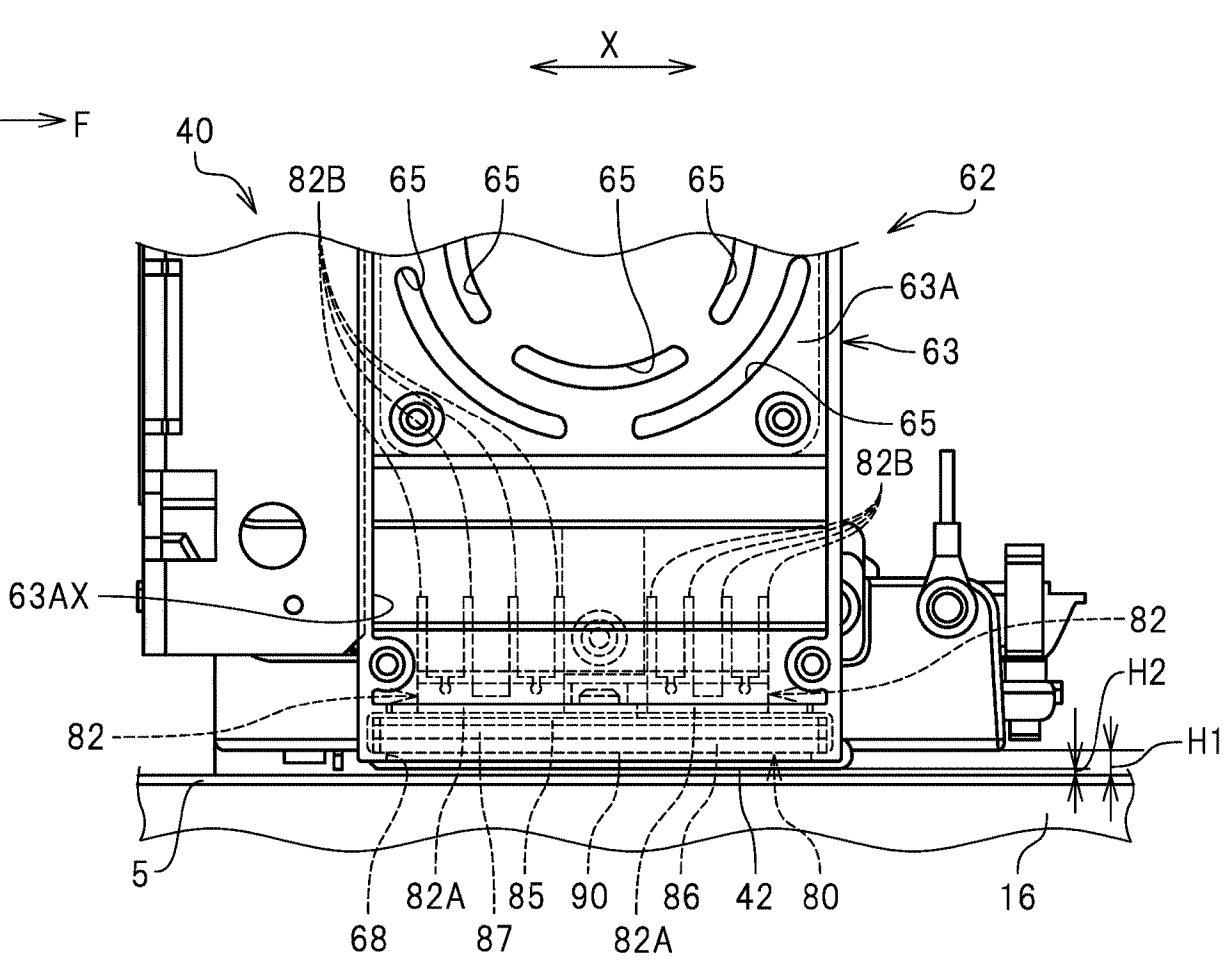
FIG. 8 is a side view of an ink head unit according to a preferred embodiment of the present invention.

As shown in FIG. 6, the case 62 includes the plurality of inlet openings 65 extending through the first wall 63A of the case main body 63. The inlet openings 65 are opened in the main scanning direction Y. The inlet openings 65 are in communication with the inner space 62A. The inlet openings 65 are usable to supply external air into the inner space 62A. The air outside of the case 62 is taken into (flows into) the inner space 62A via the inlet openings 65 as represented by arrow F1 in FIG. 6. As shown in FIG. 8, the inlet openings 65 each have a curved elliptical shape (see also FIG. 2).

As shown in FIG. 6, the case 62 includes the outlet opening 70 opened toward the platen 16 (see FIG. 1). The outlet opening 70 is in communication with the inner space 62A. The outlet opening 70 is usable to discharge the air sent from the fan 75 to the outside of the case 62. Namely, the outlet opening 70 is usable to discharge the external air, taken inside through the inlet openings 65, to the outside of the case 62. The outlet opening 70 is located below the inlet openings 65. The outlet opening 70 is opened downward. The outlet opening 70 of the left air blower 60L may be opened obliquely downward and leftward. The outlet opening 70 of the right air blower 60R may be opened obliquely downward and rightward. The outlet opening 70 is closer to the first wall 63A of the case main body 63 than the heat radiation layer 90 in the main scanning direction Y. As shown in FIG. 4, the outlet opening 70 is located in the first portion 63EA of the fifth wall 63E of the case main body 63. The outlet opening 70 extends in the sub scanning direction X. A front end 70A of the outlet opening 70 is located to the front of the foremost nozzle 41 among the nozzles 41 in the ink head 40A. A rear end 70B of the outlet opening 70 is located to the rear of the rearmost nozzle 41 among the nozzles 41 in the ink head 40A. As seen in a bottom view, the front end 70A of the outlet opening 70 is located to the front of a front end 90A of the heat radiation layer 90. As seen in a bottom view, the rear end 70B of the outlet opening 70 is located to the rear of a rear end 90B of the heat radiation layer 90. The outlet opening 70 is located on the side opposite to the ink heads 40A through 40D with respect to the heat radiation layer 90 in the main scanning direction Y. The front end 70A of the outlet opening 70 may be referred to as "one of two ends of the outlet opening in the sub scanning direction" or "the other end of the outlet opening in the sub scanning direction", and the rear end 70B of the outlet opening 70 may be referred to as "the other end of the outlet opening in the sub scanning direction" or "one of two ends of the outlet opening in the sub scanning direction". The foremost nozzle 41 may be referred to as the "outermost nozzle in one direction of the sub scanning direction" or the "outermost nozzle in the other direction of the sub scanning direction". The rearmost nozzle 41 may be referred to as the "outermost nozzle in the other direction of the sub scanning direction" or the "outermost nozzle in one direction of the sub scanning direction".

As shown in FIG. 6, the fifth wall 63E of the case 62 includes an opening 68 opened toward the platen 16 (see FIG. 1). The opening 68 is located to the side of the outlet opening 70. In this preferred embodiment, the opening 68 is located to the right of the outlet opening 70. As shown in FIG. 4, the opening 68 is defined by the fifth wall 63E of the case main body 63 and the cover 64.

As shown in FIG. 6, the fan 75 is located in the case 62. The fan 75 is located to the side of the inlet openings 65. In this preferred embodiment, the fan 75 is located to the right of the inlet openings 65. The fan 75 is located above the outlet opening 70. The fan 75 is secured to the first wall 63A of the case main body 63. The fan 75 causes the external air taken into the inner space 62A through the inlet openings 65, specifically, external air absorbed through the inlet openings 65, to flow toward the outlet opening 70 as represented by arrow F2 in FIG. 6. The fan 75 causes the air to flow through the outlet opening 70 toward the recording medium 5 placed on the platen 16.

As shown in FIG. 6, the left air blower 60L includes a filter 72. The filter 72 catches ink mist that may be generated when ink is discharged from the ink heads 40A through 40D toward the recording medium 5. The filter 72 is located between the inlet openings 65 and the fan 75. The filter 72 is inserted into the insertion hole 63DH in the fourth wall 63D of the case main body and is located in the inner space 62A. The filter 72 is detachable from the case main body 63. A top portion of the filter 72 protrudes from the case 62.

As shown in FIG. 6, the circuit board 95 is located in the case 62. The circuit board 95 is secured to the case main body 63. The circuit board 95 is located on an axis 75A of the fan 75. The circuit board 95 is located away from the fan 75. The circuit board 95 is located to the right of the fan 75. As represented by arrow F2 in FIG. 6, the air sent from the fan 75 flows at least on a surface 95A of the circuit board 95. The circuit board 95 is, for example, a glass epoxy substrate or the like. At each of a surface 95A and a rear surface 95B of the circuit board 95, a circuit is provided. The circuit board 95 includes, for example, an interface (I/F) to receive data or the like from an external device such as a host computer or the like, a central processing unit (CPU) to execute an instruction of a control program, a ROM (read only memory) having the program executable by the CPU stored thereon, a RAM (random access memory) usable as a working area where the program is developed, and a storage device, such as a memory or the like, having the above-described program or various types of data stored thereon. The circuit board 95 controls the heater 80. The circuit board 95 controls a heat source 84 (described below) of the heater 80. The circuit board 95 controls, for example, the amount of heat to be provided by the heat source 84. The circuit board 95 controls the fan 75. The circuit board 95 controls, for example, the amount of air (rotation rate of the motor) to be provided by the fan 75.

As shown in FIG. 6, the heater 80 is located in the case 62. The heater 80 raises the temperature of the air sent from the fan 75 and generates heat that is to radiate through the heat radiation layer 90 (described below). The heater 80 is located below the fan 75. The heater 80 is located below the circuit board 95. The heater 80 is secured to the case main body 63. The heater 80 includes the heat source 84, a top heat transfer plate 85, a bottom heat transfer plate 86, a side heat transfer plate 87, and a cushioning member 88. The heat source 84 generates heat. There is no specific limitation on the type of the heat source 84. The heat source 84 may be, for example, a ceramic heater. The top heat transfer plate 85 is located above the heat source 84. The bottom heat transfer plate 86 is located below the heat source 84. The side heat transfer plate 87 is located to the side of the heat source 84. The side heat transfer plate 87 is located to enclose the heat source 84. The top heat transfer plate 85, the bottom heat transfer plate 86 and the side heat transfer plate 87 are made of a metal material. Heat generated by the heat source 84 is transferred to the top heat transfer plate 85, the bottom heat transfer plate 86 and the side heat transfer plate 87. The cushioning member 88 is located between the top heat transfer plate 85 and the heat source 84. Alternatively, the cushioning member 88 may be located between the bottom heat transfer plate 86 and the heat source 84. The cushioning member 88 may be located between the bottom heat transfer plate 86 and the heat source 84 and also between the top heat transfer plate 85 and the heat source 84. The cushioning member 88 is provided to significantly reduce or prevent breakage of the heat source 84, which may be caused due to the difference between the coefficient of thermal expansion of the heat source 84 and the coefficient of thermal expansion of the top heat transfer plate 85. There is no specific limitation on the type of the cushioning member 88. The cushioning member 88 may be, for example, a ceramic fiber sheet, which is fire-protective and heat-insulating.

As shown in FIG. 6, the heater 80 includes a fin 82. The fin 82 is provided on the top heat transfer plate 85. The fin 82 is located in the inner space 62A. The heat of the heat source 84 is transferred to the fin 82 via the top heat transfer plate 85. As shown in FIG. 8, the fin 82 includes a base 82A and a plurality of extending portions 82B extending upward from the base 82A. The base 82A is in contact with the top heat transfer plate 85. The air sent from the fan 75 is heated by heat exchange while passing the fin 82 (typically, while passing between the extending portions 82B).

The heat radiation layer 90 is a layer that dissipates heat to outside and allows heat to radiate efficiently. As shown in FIG. 6, the heat radiation layer 90 is located in a portion of the heater 80 that faces the platen 16. In this preferred embodiment, the heat radiation layer 90 is provided on a bottom surface 86B of the bottom heat transfer plate 86. Heat generated by the heater 80 is transferred to the heat radiation layer 90. Heat generated by the heat source 84 is transferred to the heat radiation layer 90 via the bottom heat transfer plate 86. The heat radiation layer 90 is exposed outside through the opening 68 located in the case 62. The heat radiation layer 90 causes heat, generated by the heat source 84, to radiate toward the recording medium 5 placed on the platen 16. As shown in FIG. 4, the front end 90A of the heat radiation layer 90 is located to the front of the foremost nozzle 41 among the nozzles 41 in the ink head 40A. The rear end 90B of the heat radiation layer 90 is located to the rear of the rearmost nozzle 41 among the nozzles 41 in the ink head 40A. Length L1 of the heat radiation layer 90 in the main scanning direction Y is longer than length L2 of the outlet opening 70 in the main scanning direction Y. As shown in FIG. 8, distance H1 between a surface of the recording medium 5 and the heat radiation layer 90 is longer than distance H2 between the surface of the recording medium 5 and the nozzle surface 42. The front end 90A of the heat radiation layer 90 may be referred to as "one of two ends of the heat radiation layer in the sub scanning direction" or "the other end of the heat radiation layer in the sub scanning direction", and the rear end 90B of the heat radiation layer 90 may be referred to as "the other end of the heat radiation layer in the sub scanning direction" or "one of two ends of the heat radiation layer in the sub scanning direction". The foremost nozzle 41 may be referred to as the "outermost nozzle in one direction of the sub scanning direction" or the "outermost nozzle in the other direction of the sub scanning direction". The rearmost nozzle 41 may be referred to as the "outermost nozzle in the other direction of the sub scanning direction" or the "outermost nozzle in one direction of the sub scanning direction".

The heat radiation layer 90 is, for example, a black layer. There is no specific limitation on the material of the heat radiation layer 90. In this preferred embodiment, the heat radiation layer 90 is made of a heat radiation paint, for example. The heat radiation paint is applied to the bottom surface 86B of the bottom heat transfer plate 86 to form the heat radiation layer 90. The heat radiation paint contains at least a metal oxide. The "metal oxide" refers to, for example, aluminum oxide, silicon dioxide, copper oxide, titanium oxide, manganese dioxide, manganese oxide, iron oxide, cobalt oxide, chromium oxide or the like. The "heat radiation paint" is, for example, a far infrared radiation paint. The heat radiation paint may contain a liquid resin such as a silica-based inorganic binder, silicone, polyolefin, acrylic resin, urethane, epoxy or the like and a heat radiation ceramic material dispersed in the liquid resin. A preferred heat radiation paint transfers heat in a wavelength range having a high emissivity for ink and having a low emissivity for the recording medium 5. The "wavelength range having a high emissivity for ink" refers to a wavelength range of infrared that easily dries ink and is set in accordance with the components of the ink. The "wavelength range having low emissivity for the recording medium 5" refers to a wavelength range of infrared that does not destroy, namely, damage the recording medium 5 and is set in accordance with the material of the recording medium 5. For example, a preferred heat radiation paint may radiate heat in a wavelength range having an emissivity of about 60% to about 90% for the ink discharged toward the recording medium 5 and an emissivity of about 40% to about 80% for the recording medium 5.

Figure 5:
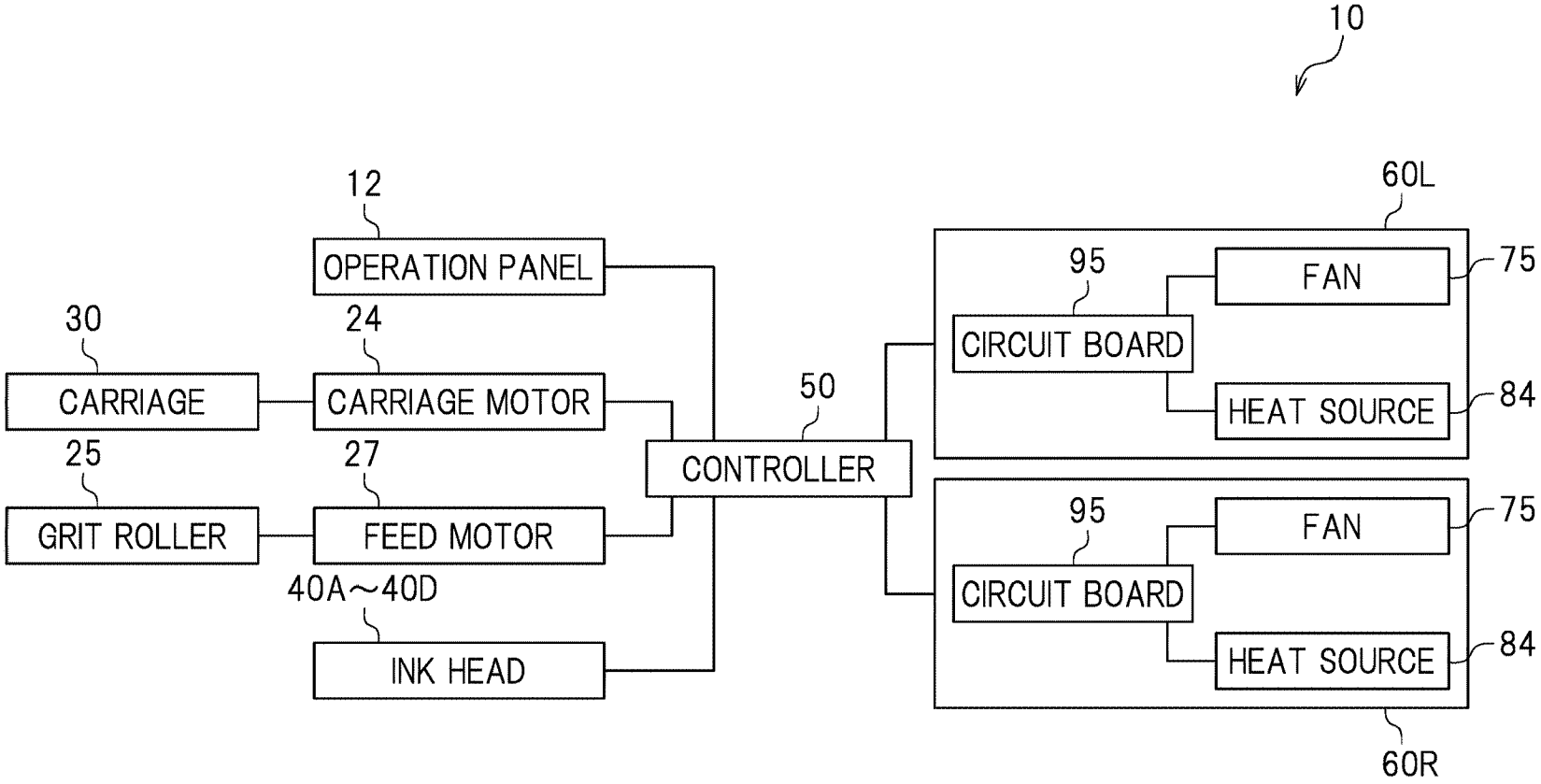
FIG. 5 is a block diagram of a printer according to a preferred embodiment of the present invention.

As shown in FIG. 5, the controller 50 controls printing on the recording medium 5. There is no specific limitation on the structure of the controller 50. The controller 50 is, for example, a microcomputer. There is no specific limitation on the hardware structure of the microcomputer. The microcomputer includes, for example, an I/F, a CPU, a ROM, a RAM and a storage device. As shown in FIG. 1, the controller 50 is provided in the printer main body 10*a*. The controller 50 does not need to be provided in the printer main body 10*a*. The controller 50 may be, for example, a computer provided outside the printer main body 10*a*. In this case, the controller 50 is communicably connected with the printer main body 10*a* in a wired or wireless manner.

As shown in FIG. 5, the controller 50 is communicably connected with the operation panel 12, the carriage motor 24 of the head moving mechanism 31, the feed motor 27 of the medium transfer mechanism 32, the ink heads 40A through 40D, and the circuit board 95. The controller 50 controls the operation panel 12, the carriage motor 24, the feed motor 27, the ink heads 40A through 40D, and the left air blower 60L and the right air blower 60R via the circuit board 95.

As shown in FIG. 5, the controller 50 controls the driving of the carriage motor 24 to control the rotation of the pulley 22 and the moving of the belt 23 (see FIG. 1). Thus, the controller 50 controls the movement of the ink heads 40A through 40D in the main scanning direction Y. The controller 50 controls the driving of the feed motor 27 to control the rotation of the grit rollers 25. Thus, the controller 50 controls the movement of the recording medium 5 placed on the platen 16 in the sub scanning direction X. The controller 50 controls the timing at which the ink heads 40A through 40D discharge ink, the amount of ink to be discharged, and the like. The controller 50 controls the amount of air to be provided by the fan 75 of each of the left air blower 60L and the right air blower 60R, the amount of heat to be provided by the heat source 84, and the like via the circuit board 95.

The structure of the printer 10 is described above. Now, an operation of the left air blower 60L and the right air blower 60R performed to print an image on the recording medium 5 will be described. In the case where the carriage 30 moves in the advancing direction Y1 and as a result, the ink is discharged toward the recording medium 5 through the nozzles 41 of the ink heads 40A through 40D, the controller 50 controls the right air blower 60R via the circuit board 95. Namely, the controller 50 controls the amount of air to be provided by the fan 75 of the right air blower 60R and the amount of heat to be provided by the heat source 84 of the right air blower 60R. Air taken into the inner space 62A of the case 62 through the inlet openings 65 of the right air blower 60R cools the electronic components mounted on the circuit board 95 and also is heated by heat generated by the electronic components while flowing on the surface 95A of the circuit board 95, and flows toward the fin 82. Since the fin 82 is already heated by the heat of the heat source 84, the air passing the fin 82 is further heated. The air sufficiently heated by the circuit board 95 and the fin 82 flows through the outlet opening 70 toward the ink discharged onto the recording medium 5. This promotes the drying of the ink. In addition, the heat of the heat source 84 radiates through the heat radiation layer 90 provided on the bottom heat transfer plate 86 toward the ink discharged onto the recording medium 5. This further promotes the drying of the ink. In the case where the carriage 30 moves in the advancing direction Y1, the controller 50 may control the left air blower 60L via the circuit board 95. When the carriage 30 moves in the advancing direction Y1, the ink has not yet been discharged toward the recording medium 5 located below the left air blower 60L. However, the controller 50 may cause the heated air to be sent to the recording medium 5 or cause the heat to radiate through the heat radiation layer 90 toward the recording medium 5, and thus may heat the recording medium 5 before the ink is discharged. This improves the fixing property of the ink to the recording medium 5. In this preferred embodiment, about 80% of the heat generated by the heat source 84 is used as convective heat, whereas about 20% of the heat is used as radiating heat, for example. Namely, about 80% of the heat is used to heat the air, sent from the fan 75 and discharged outside through the outlet opening 70, by heat convection via the fin 82, for example. About 20% of the heat radiates outside through the heat radiation layer 90 described below, for example. The above ratio of the heat used as convective heat and the heat used as radiating heat is merely an example and is not limiting.

In the case where the carriage 30 moves in the returning direction Y2 and as a result, the ink is discharged toward the recording medium 5 through the nozzles 41 of the ink heads 40A through 40D, the controller 50 controls the left air blower 60L via the circuit board 95. Namely, the controller 50 controls the amount of air to be provided by the fan 75 of the left air blower 60L and the amount of heat to be provided by the heat source 84 of the left air blower 60L. In the case where the carriage 30 moves in the retuning direction Y2, the controller 50 may control the right air blower 60R via the circuit board 95. When the carriage 30 moves in the returning direction Y2, the ink discharged during the movement of the carriage 30 in the advancing direction Y1 is present on the recording medium 5 located below the right air blower 60R. Therefore, the controller 50 may cause the heated air to be further sent to the ink discharged onto the recording medium 5 or cause the heat to further radiate through the heat radiation layer 90 toward the recording medium 5, and thus may dry the ink with more certainty.

As described above, in the printer 10 in the present preferred embodiment, the air heated by the heater 80 is sent to the recording medium 5 placed on the platen 16 via the outlet opening 70. At least a portion of the heat generated by the heater radiates through the heat radiation layer 90. The heat radiation layer 90 is located in a portion of the heater 80 that faces the platen 16 and is exposed outside through the opening 68 in the case 62. Therefore, the heat radiating through the heat radiation layer 90 reaches the ink discharged onto the recording medium 5. In this manner, the heat generated by the heater 80 is used efficiently, so that the ink discharged onto the recording medium 5 is directly dried by the heated air flowing through the outlet opening 70 and the heat radiating through the heat radiation layer 90. Therefore, in the case where the recording medium 5 has a common thickness and even in the case where the recording medium 5 is relatively thick, ink discharged onto the recording medium 5 is dried efficiently by the air flowing through the outlet opening 70 and the heat radiating through the heat radiation layer 90. This prevents a situation where the ink is not easily dried due to the thickness of the recording medium 5 or the like. Since the heat generated by the heater 80 is used efficiently, the heater 80 may be relatively compact, and thus the left air blower 60L and the right air blower 60R may be prevented from becoming large.

In the printer 10 in this preferred embodiment, the heat radiation layer 90 is made of a heat radiation paint. The heat radiation paint contains at least a metal oxide. This allows the heat radiation layer 90 to be formed on the bottom surface 86B, of the lower heat transfer plate 86, facing the platen 16 by a simple method of applying the heat radiation paint to a portion of the heater 80 that faces the platen 16.

In the printer 10 in this preferred embodiment, the case 62 includes the inner space 62A, which is in communication with the inlet openings 65 and the outlet opening 70 and through which the air sent from the fan 75 passes. The heater 80 includes the fin 82 located in the inner space 62A. Since the fin 82A of the heater 80 is located in the inner space 62A, the heat of the heater 80 is efficiently added to the air passing the inner space 62A.

In the printer 10 in this preferred embodiment, the left air blower 60L and the right air blower 60R each include the circuit board 95 controlling the heater 80. The circuit board 95 is located away from the fan 75, so as to be in the case 62 and on the axis 75A of the fan 75. The circuit board 95 includes the surface 95A on which the air sent from the fan 75 flows. The circuit board 95 controls the heater 80, and as a result, heat is generated in the circuit board 95. Since the circuit board 95 is located on the axis 75A of the fan 75, the air sent from the fan 75 flows on the surface 95A of the circuit board 95. Thus, the circuit board 95 is cooled and the air sent from the fan 75 is heated. As can be seen, a fan that cools the circuit board 95 does not need to be provided separately, which decreases the size of each of the left air blower 60L and the right air blower 60R and also improves the heating efficiency.

In the printer 10 in this preferred embodiment, the left air blower 60L and the right air blower 60R each include the filter provided between the inlet openings 65 and the fan 75. Discharge of the ink from the ink heads 40A through 40D results in ink mist being generated around the carriage 30. The filter 72 provided in the vicinity of the inlet openings 65 catches the ink mist and prevents the ink mist from entering the inside of the case 62.

In the printer 10 in this preferred embodiment, the front end 70A of the outlet opening 70 is located to the front of the foremost nozzle 41 among the plurality of nozzles 41, and the rear end 70B of the outlet opening 70 is located to the rear of the rearmost nozzle 41 among the plurality of nozzles 41. Such a structure allows the heated air to be sent through the outlet opening 70 toward the ink discharged onto the recording medium 5 more effectively.

In the printer 10 in this preferred embodiment, the front end 90A of the heat radiation layer 90 is located to the front of the foremost nozzle 41 among the plurality of nozzles 41, and the rear end 90B of the heat radiation layer 90 is located to the rear of the rearmost nozzle 41 among the plurality of nozzles 41. Such a structure allows the heat generated by the heater 80 to effectively radiate toward the ink discharged onto the recording medium 5.

In the printer 10 in this preferred embodiment, the heater 80 includes the heat source 84 generating heat, the top heat transfer plate 85 located above the heat source 84, the bottom heat transfer plate 86 located below the heat source 84, and the cushioning member 88 located between the heat source 84 and the top heat transfer plate 85. Even if the heat source 84 is expanded due to high temperature, the cushioning member 88 absorbs the expansion. Therefore, the heat source 84 is prevented from being broken by the top heat transfer plate 85 or the bottom heat transfer plate 86. The heat radiation layer 90 is provided on the bottom surface 86B, of the bottom heat transfer plate 86, facing the platen 16. Such a structure allows the heat of the heat source 84 to be efficiently transferred to the heat radiation layer 90 via the bottom heat transfer plate 86. The heat source 84 may be, for example, a ceramic heater. The ceramic heater generates a relatively large amount of heat while being compact, and thus is preferably usable as the heat source 84 of each of the left air blower 60L and the right air blower 60R.

Preferred embodiments according to the present invention are described above. Each of the above-described preferred embodiments is merely an example, and the present invention may be carried out in various other preferred embodiments.

In a preferred embodiment described above, the outlet opening 70 is located on the side opposite to the ink heads 40A through 40D with respect to the heat radiation layer 90. The present invention is not limited to this. For example, the heat radiation layer 90 may be located on the side opposite to the ink heads 40A through 40D with respect to the outlet opening 70. Namely, in the left air blower 60L, the outlet opening 70 may be located to the right of the heat radiation layer 90 and to the left of the ink heads 40A through 40D.

In a preferred embodiment described above, the heat radiation layer 90 is formed by applying a heat radiation paint. Alternatively, the heat radiation layer 90 may be a heat radiation sheet or a heat radiation plate. The heat radiation sheet may be a sheet containing a resin such as an acrylic resin, polypropylene, silicone, polyolefin, urethane, epoxy or the like and heat radiation ceramic powder dispersed therein. Even in this case, substantially the same effect as above is provided.

In a preferred embodiment described above, the printer 10 is structured such that the carriage 30 is movable in the main scanning direction Y whereas the recording medium 5 placed on the platen 16 is movable in the sub scanning direction X. The present invention is not limited to this. The movement of carriage 30 and the movement of the recording medium 5 are relative to each other. Either the carriage 30 or the recording medium 5 may be movable in the main scanning direction Y or the sub scanning direction X. For example, the recording medium 5 may be unmovable, whereas the carriage 30 may be movable both in the main scanning direction Y and the sub scanning direction X. Alternatively, both of the carriage 30 and the recording medium 5 may be movable both in the main scanning direction Y and the sub scanning direction X.

The technology disclosed herein is usable for various types of printers. The technology disclosed herein is usable for a so-called roll-to-roll printer 10 described in the above preferred embodiment, in which the roll recording medium 5 is transferred, and is also usable for, for example, a flat bed inkjet printer.

The terms and expressions used herein are for description only and are not to be interpreted in a limited sense. These terms and expressions should be recognized as not excluding any equivalents to the elements shown and described herein and as allowing any modification encompassed in the scope of the claims. The present invention may be embodied in many various forms. This disclosure should be regarded as providing preferred embodiments of the principle of the present invention. These preferred embodiments are provided with the understanding that they are not intended to limit the present invention to the preferred embodiments described in the specification and/or shown in the drawings. The present invention is not limited to the preferred embodiments described herein. The present invention encompasses any of preferred embodiments including equivalent elements, modifications, deletions, combinations, improvements and/or alterations which can be recognized by a person of ordinary skill in the art based on the disclosure. The elements of each claim should be interpreted broadly based on the terms used in the claim, and should not be limited to any of the preferred embodiments described in this specification or used during the prosecution of the present application.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. An inkjet printer, comprising:

a table on which a recording medium is to be placed;

an ink head that is located above the table and discharges ink toward the recording medium placed on the table;

a carriage that has the ink head mounted thereon and is movable in a main scanning direction; and an air blower that is mounted on the carriage and blows air toward the recording medium; wherein the air blower includes:

a case including an inlet opening through which external air is taken inside, an outlet opening through which the external air, taken inside through the inlet opening, is discharged outside, and an opening in a portion facing the table, the case being located at least to one side of the ink head in the main scanning direction;

a fan that is located in the case, absorbs the external air through the inlet opening and sends air through the outlet opening toward the recording medium placed on the table;

a heater that is located in the case and heats the air sent from the fan; and a heat radiation layer that is exposed outside through the opening and radiates at least a portion of heat generated by the heater.

2. The inkjet printer according to claim 1, wherein the heat radiation layer is made of a heat radiation paint.

3. The inkjet printer according to claim 2, wherein the heat radiation paint contains at least a metal oxide.

4. The inkjet printer according to claim 1, wherein the case includes an inner space in communication with the inlet opening and the outlet opening and through which the air sent from the fan passes; and the heater includes a fin located in the inner space.

5. The inkjet printer according to claim 1, wherein the air blower includes a circuit board including a surface on which the air sent from the fan flows, that is spaced away from the fan so as to be in the case and on an axis of the fan, and that controls the heater.

6. The inkjet printer according to claim 1, wherein the air blower includes a filter provided between the inlet opening and the fan.

7. The inkjet printer according to claim 1, wherein the ink head includes a plurality of nozzles through which the ink is discharged toward the recording medium, the plurality of nozzles being arrayed in a sub scanning direction perpendicular to the main scanning direction;

the outlet opening extends in the sub scanning direction; and one of two ends of the outlet opening in the sub scanning direction is located outside of the outermost nozzle in one direction of the sub scanning direction among the plurality of nozzles, and the other end of the outlet opening in the sub scanning direction is located outside of the outermost nozzle in the other direction of the sub scanning direction among the plurality of nozzles.

8. The inkjet printer according to claim 7, wherein the heat radiation layer extends in the sub scanning direction; and one of two ends of the heat radiation layer in the sub scanning direction is located outside of the outermost nozzle in one direction of the sub scanning direction among the plurality of nozzles, and the other end of the heat radiation layer in the sub scanning direction is located outside of the outermost nozzle in the other direction of the sub scanning direction among the plurality of nozzles.

9. The inkjet printer according to claim 1, wherein the heater includes a heat source that generates heat, a top heat transfer plate located above the heat source, a bottom heat transfer plate located below the heat source, and a cushioning member located between the heat source and the top heat transfer plate or between the heat source and the bottom heat transfer plate; and the heat radiation layer is located on a surface, of the bottom heat transfer plate, facing the table.

10. The inkjet printer according to claim 9, wherein the heat source is a ceramic heater.

* * * * *